US008672147B2

(12) United States Patent
Lam

(10) Patent No.: US 8,672,147 B2
(45) Date of Patent: Mar. 18, 2014

(54) EXPANDABLE CLOTHES FRAME

(75) Inventor: Wing Yiu Lam, Shatin (HK)

(73) Assignee: Sincere International Trading Co. Ltd., Fotan, Shatin (HK)

( * ) Notice: Subject to any disclaimer, the term of this patent is extended or adjusted under 35 U.S.C. 154(b) by 69 days.

(21) Appl. No.: 13/358,021

(22) Filed: Jan. 25, 2012

(65) Prior Publication Data

US 2012/0241398 A1 Sep. 27, 2012

(30) Foreign Application Priority Data

Mar. 25, 2011 (HK) ..... 11103039.4

(51) Int. Cl.

| | |
|---|---|
| ***A47F 7/18*** | (2006.01) |
| ***A47G 25/06*** | (2006.01) |
| ***A47F 7/24*** | (2006.01) |
| ***A47F 5/10*** | (2006.01) |
| ***A47F 5/13*** | (2006.01) |
| ***A47B 43/00*** | (2006.01) |
| ***A47B 46/00*** | (2006.01) |

(52) U.S. Cl.

CPC . *A47G 25/06* (2013.01); *A47F 7/18* (2013.01); *A47F 7/24* (2013.01); *A47F 5/10* (2013.01); *A47F 5/13* (2013.01); *A47B 43/00* (2013.01); *A47B 46/005* (2013.01)

USPC ..... 211/149; 211/85.3; 211/201

(58) Field of Classification Search

USPC ..... 211/201, 204, 206, 195, 198, 200, 149, 211/85.3, 175, 189; 108/167, 163, 115, 108/170, 162, 166, 169, 187, 188; 16/365, 16/373, 366; 248/166, 150; 403/53, 54, 403/389, 391, 396; 280/42, 79.3, 47.35, 280/651, 639

See application file for complete search history.

(56) References Cited

U.S. PATENT DOCUMENTS 604,875 A * 5/1898 Canedy ..... 211/36
1,167,550 A * 1/1916 Forsyth ..... 108/163

(Continued)

FOREIGN PATENT DOCUMENTS

JP 2007-282989 A 11/2007
KR 10-0694884 B1 3/2007

(Continued)

OTHER PUBLICATIONS

United Kingdom Search Report for HK 11103093.4 dated on Apr. 15, 2011.

(Continued)

*Primary Examiner* — Jennifer E Novosad
(74) *Attorney, Agent, or Firm* — Buchanan Ingersoll & Rooney PC

(57) ABSTRACT

An expandable clothes frame includes a pair of laterally disposed end support assemblies for engagement with a ground surface, two longitudinally disposed foldable assemblies each extending between and hingedly engaged with each of the end support assemblies, wherein each foldable assembly is provided in two portions having relative movement therebetween to allow folding of each foldable assembly about a fold axis between the pair of end support assemblies, a linkage assembly extending longitudinally between the foldable assemblies, and a locking assembly for securing the two portions of at least one of the foldable assemblies relative to each other so as to secure the frame in the extended configuration. Upon the frame being urged towards an extended configuration the engageable and cooperative portions are urged towards each other and engage so as to secure the two portions relative to each other and maintain the frame in the extended configuration.

14 Claims, 10 Drawing Sheets

(56) References Cited

U.S. PATENT DOCUMENTS

| | | | | | |
|---|---|---|---|---|---|
| 1,198,431 | A * | 9/1916 | Forsyth | 108/163 |
| 1,304,847 | A * | 5/1919 | Blais et al. | 108/163 |
| 1,612,937 | A * | 1/1927 | Mitchell | 108/59 |
| 2,249,234 | A * | 7/1941 | Srodulski | 312/42 |
| 2,584,489 | A * | 2/1952 | Morrison | 211/149 |
| 2,938,632 | A * | 5/1960 | Mondineu | 108/106 |
| 3,093,247 | A * | 6/1963 | Erickson | 108/188 |
| 4,450,971 | A * | 5/1984 | Kashiwabara | 211/201 |
| 5,131,547 | A * | 7/1992 | Goldberg | 211/149 |
| 5,163,569 | A * | 11/1992 | Buff | 211/201 |
| 6,123,207 | A * | 9/2000 | Mast | 211/149 |
| 6,213,494 | B1 * | 4/2001 | Liaw | 280/651 |
| 6,685,199 | B2 * | 2/2004 | Stravitz et al. | 280/42 |
| 6,976,596 | B2 * | 12/2005 | Brooks | 211/153 |
| 7,080,640 | B2 * | 7/2006 | Sanders et al. | 126/30 |
| 7,389,887 | B2 * | 6/2008 | Liang | 211/149 |
| 7,637,220 | B2 * | 12/2009 | Fu | 108/163 |
| 8,109,526 | B2 * | 2/2012 | Mason et al. | 280/47.35 |
| 8,256,630 | B2 * | 9/2012 | Zhu et al. | 211/149 |
| 2004/0238469 | A1 * | 12/2004 | Ng | 211/149 |
| 2006/0226101 | A1 * | 10/2006 | Liang | 211/149 |
| 2011/0068072 | A1 * | 3/2011 | Zhu et al. | 211/149 |

FOREIGN PATENT DOCUMENTS

| | | | |
|---|---|---|---|
| KR | 2009-0010005 | U | 10/2009 |
| KR | 10-0953909 | B1 | 4/2010 |
| TW | 244026 | U | 9/2004 |

OTHER PUBLICATIONS

Official Action issued by Chinese Patent Office on Nov. 13, 2013 in Chinese Application No. 201110234742.7, and partial English language translation of Official Action (11 pgs).

* cited by examiner

EXPANDABLE CLOTHES FRAME

FIELD OF THE INVENTION

The present invention relates to the field of a frame for hanging articles of clothing and, more particularly, to an expandable clothes frame for supporting articles of clothing or the like.

BACKGROUND OF THE INVENTION

Limited living space nowadays has posed difficulties for hanging clothes at home. In modern housing apartments, for example, balconies or specific areas for hanging clothes are not usually provided. This means that clothes drying will need to be done by use of clothes drying machines or laundry service providers, which could be costly and is energy-consuming.

Foldable clothes frames have been used for supporting clothes or clothes hangers. Typically, a foldable clothes frame is moveable between an expanded configuration and a retracted configuration. The expanded configuration provides support for hanging clothes, and the retracted configuration facilitates transportation and storage.

A foldable clothes frame may require locking mechanism for securing the expanded frame from moving into its retracted configuration. Expanded frame, if unlocked, may collapse or otherwise return to the retracted configuration relatively easily. This may cause the clothes being supported to fall over, and thus cause inconvenience and economic loss to users. Furthermore, an unlocked or unsecured clothes frame, when collapse in an uncontrolled or unattended manner, may injure humans or animals, or otherwise damage the properties nearby. A foldable clothes frame without robust locking mechanism will also make it vulnerable in an outdoor environment, where strong wind and sunshine may be present.

OBJECT OF THE INVENTION

It is an object of the present invention to provide an expandable clothes frame which overcomes or substantially ameliorates at least some of the deficiencies of the prior art.

SUMMARY OF THE INVENTION

In a first aspect, the present invention provides an expandable clothes frame moveable between a retracted configuration for storage and an extended configuration for supporting articles of clothing, the frame comprising:

a pair of laterally disposed end support assemblies for engagement with and support by a ground surface upon which the frame is to be supported and extending longitudinally therefrom;

two longitudinally disposed foldable assemblies each extending between and hingedly engaged with each of the end support assemblies, wherein each foldable assembly is provided in two portions having relative movement therebetween to allow folding of each foldable assembly about a fold axis between the pair of end support assemblies and wherein the fold axes of each foldable assembly are coplanar and parallel;

a linkage assembly extending longitudinally between the foldable assemblies, wherein the linkage assembly is configured such that upon the foldable assemblies being folded about the fold axes the end support assemblies are urged from towards each other and are maintained parallel with each other as the frame is moved from the extended configuration towards the retracted configuration; and a locking assembly for securing the two portions of at least one of the foldable assemblies relative to each other so as to secure the frame in said extended configuration, the locking assembly includes engageable and cooperative portions;

wherein upon the frame being urged towards the extended configuration the engageable and cooperative portions are urged towards each other and engage so as to secure the two portions relative to each other and maintain the frame in the extended configuration; and upon the frame being urged from the extended configuration towards the retracted configuration the engagement of the cooperative portions is overcome to allow the frame to be moved to the retracted configuration.

The fold axes of the foldable assemblies preferably extend in a plane substantially midway between the pair of end support assemblies.

Preferably, the linkage assembly comprises a linkage member extend longitudinally and midway between two lateral sides of each of the foldable assemblies and more preferably, the linkage assembly comprises a pair of oppositely disposed linkage members, the pair of linkage members bridging the portions of the foldable assemblies at two lateral sides of the foldable assemblies and across the fold axes.

Preferably, the linkage assembly has a generally elongate structure.

The linkage assembly may be hingedly engaged with the foldable assemblies about the fold axes. Alternatively, the linkage assembly may be hingedly engaged with each of the two portions of the foldable assemblies equidistantly about the respective fold axes.

The engageable and cooperative portions may comprise at least one protrusion and at least one recess, the at least one protrusion being configured to be received within the at least one recess for securing the two portions of at least one of the foldable assemblies relative to each other.

The at least one protrusion and the at least one recess may be disposed respectively at each of the two portions of at least one of the foldable assemblies.

The at least one protrusion and the at least one recess may provided at two lateral sides of at least one of the foldable assemblies.

The at least one recess is disposed at the linkage assembly to receive at least one protrusion disposed at each of the two portions of at least one of the foldable assemblies.

Preferably, the locking assembly comprises a biasing means for resiliently urging the at least one protrusion into the at least one recess.

The foldable assemblies each comprises a pair of laterally disposed elongate arm members being maintained in a parallel spaced apart relationship by a plurality of spaced apart clothes hanging members extending therebetween. Alternatively, the foldable assemblies each comprises a plurality of laterally extending spaced apart clothes hanging members.

Preferably, the end support assemblies each comprises a pair of generally upright support stands maintained in a parallel spaced apart relationship by a plurality of longitudinally spaced apart bars extending therebetween.

The end support assemblies may each comprises a pair of wheels for engaging with the ground surface.

In an embodiment, the expandable clothes frame may further comprise a third end support assembly maintained in a parallel laterally spaced apart relationship with the pair of laterally disposed end support assemblies by a third foldable assemblies, and may further comprise a fourth foldable assembly provided in two portions and hingedly engaged with each of the pair of end support assemblies, the fourth foldable assembly being longitudinally spaced apart from the two longitudinally disposed foldable assemblies and maintained parallel with the two longitudinally disposed foldable assemblies by the linkage member.

Preferably, when in the extended configuration, the foldable assemblies are substantially in a horizontal plane.

Preferably, at least one protrusion and the at least one recess formed from polymeric material.

The end support assemblies and the foldable assemblies may be coated with oxidation-resistant material. Alternatively, the end support assemblies and the foldable assemblies may be formed from aluminium or an aluminium alloy material.

BRIEF DESCRIPTION OF THE DRAWINGS

Preferred embodiments of the present invention will be explained in further detail below by way of examples and with reference to the accompanying drawings, in which:—

DETAILED DESCRIPTION OF THE PREFERRED EMBODIMENTS

Figure 1:
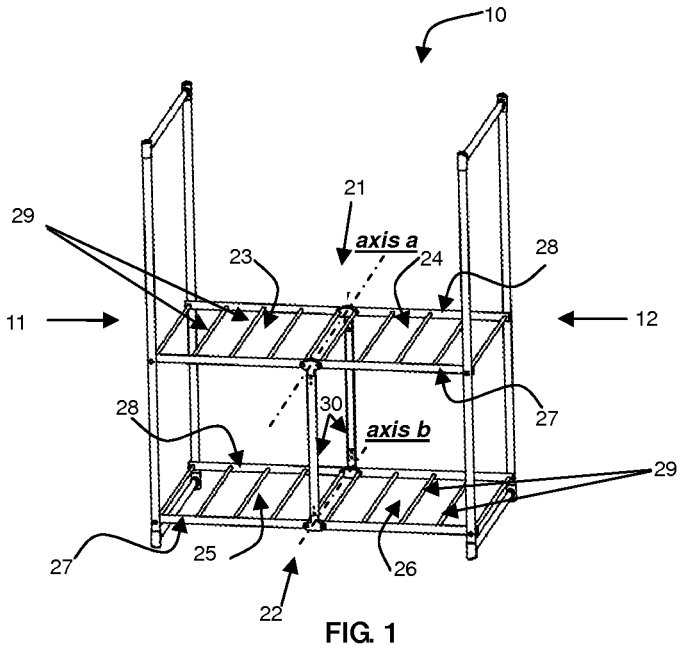
FIG. 1 shows a perspective view of an embodiment of an expandable clothes frame according to the present invention, in which the frame is in an extended configuration.
Figure 2:
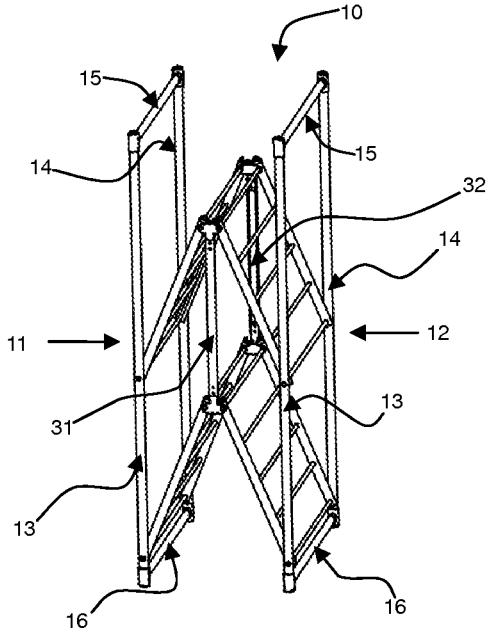
FIG. 2 shows a perspective view of the expandable clothes frame of FIG. 1 in which the frame is in a partially retracted configuration.
Figure 3:
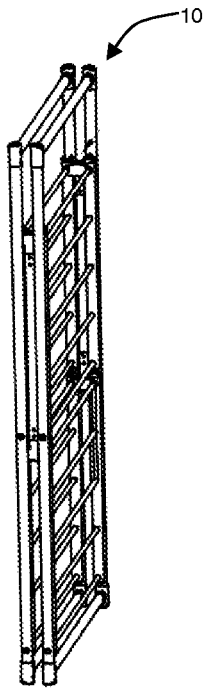
FIG. 3 shows a perspective view of the expandable clothes frame of FIG. 1 in which the frame is in a fully retracted configuration.

Referring to FIGS. 1, 2 and 3, there is shown an exemplary representation of an expandable clothes frame 10 according to the present invention. The expandable clothes frame 10 as claimed and described is suitable for hanging or supporting articles of clothing or otherwise for supporting clothes hangers, and is suitable for use either indoor or outdoor. The expandable clothes frame 10 is moveable between a retracted configuration, as shown in FIG. 3, for ease of transportation or storage, and an extended configuration, as shown in FIG. 1, for hanging and supporting clothes. Furthermore, the expandable clothes frame 10 may be held in a partially retracted configuration, as shown in FIG. 2, for hanging articles of clothing.

The expandable clothes frame 10 comprises a pair of laterally disposed end support assemblies 11 and 12, upper or lower foldable assemblies 21 and 22, and a linkage assembly 30 comprising a pair of linkage members 31 and 32. In the present embodiment, the end support assemblies 11 and 12, the upper or lower foldable assemblies 21 and 22, and the linkage members 31 and 32 are formed of aluminium alloy for mitigating the risk of the frame 10 to become degraded due to outdoor environmental factors such as prolonged exposure to rain, sunshine causing UV degradation and the like. However, it will be appreciated that these assemblies and members may be formed of other material, with the surfaces of the end support assemblies 11 and 12, upper or lower foldable assemblies 21 and 22, and linkage members 31 and 32 being coated with oxidation-resistant material.

The pair of end support assemblies 11 and 12 extend longitudinally or vertically from a ground surface upon which the frame 10 is to be supported. As shown in FIG. 2, each of the end support assemblies 11 and 12 comprises a pair of upright support stands 13 and 14. The pair of upright support stands 13 and 14 extend longitudinally from the ground surface and are maintained in a parallel spaced apart relationship by a plurality of bars 15 and 16. The plurality of bars 15 and 16 are disposed spaced apart in the longitudinal or vertical direction and extend between the respective pair of support stands 13 and 14. Those skilled in the art will appreciate that the bars may be used for supporting clothes hangers or articles of clothing and that the number of bars may vary as needed. Although not shown in the exemplary embodiment, each of the end support stands 13 and 14 may comprise a wheel for ease of transportation and storage. Furthermore, those skilled in the art will readily understand that the pair of end support assemblies 11 and 12 may not need to be arranged upright with respect to the ground surface. For instance, the end support assemblies 11 and 12 may be slightly tapered away from the ground surface without departing from the scope of the present invention.

As shown in FIG. 1, in which the expandable clothes frame 10 is in the extended configuration, the upper or lower foldable assemblies 21 and 22 extend longitudinally between the end support assemblies 11 and 12. The upper foldable assembly 21 is provided with two portions 23 and 24, and the lower foldable assembly 22 is provided with two portions 25 and 26. The portions 23, 24, 25 and 26 are linked together by the linkage members 31 and 32 of the linkage assembly 30 at their folding ends, and are hingedly coupled to the pair of end support assemblies 11 and 12. As such, these portions of foldable assemblies may pivot relative to each other, thereby allowing the upper and lower foldable assemblies 21 and 22 to fold about axes a and b, respectively, which are located between the end support assemblies 11 and 12. Although the exemplary embodiment shows that both of the axes a and b extend parallel with respect to each other in a plane substantially midway between the pair of end support assemblies, those skilled in the art will readily appreciate that the axes may lie in different planes and may be positioned away from the mid-point between the end support assemblies 11 and 12.

As best shown in FIGS. 1 and 2, each of the foldable assemblies 21 and 22 comprises a pair of elongate lateral arms 27 and 28 which are maintained in a parallel spaced apart relationship by a plurality of spaced apart clothes hanging members 29. In the present embodiment, the plurality of clothes hanging members 29 extend in a direction parallel to the axes a and b. However, those skilled in the art will appreciate that the hanging members 29 may extend in the lateral direction of the frame 10.

The pair of linkage members 31 and 32 extend longitudinally between the upper and lower foldable assemblies 21 and 22. In the present embodiment, the linkage members 31 and 32 are oppositely disposed and mounted to the pair of elongate lateral arms 27 and 28, and are made of generally elongate metal plates. However, those skilled in the art will appreciate that the linkage members 31 and 32 may be of other structure (for example dumbbell shape, tubular structure, etc.) or material (for example plastic), without departing from the scope of the present invention. The linkage members 31 and 32 bridge the portions 23, 24, 25 and 26 of the foldable assemblies across the respective fold axes a and b and bridge the upper and lower foldable assemblies 21 and 22. However, it will be appreciated that a single linkage member may be used to bridge the upper and lower foldable assemblies 21 and 22, and the single linkage member may either be mounted to the foldable assemblies 22 and 22 at either one of the pair of elongate lateral arms 27 and 28, or at a point intermediate the two lateral arms 27 and 28. By bridging the portions 23, 24, 25 and 26 as shown in FIGS. 1, 2 and 3, when the end support assemblies 11 and 12 are urged towards each other and the frame is moved from the extend configuration towards the retracted configuration, the portions 23, 25, and the portions 24, 26 of the upper and lower foldable assemblies 21 and 22 are maintained parallel with each other. In the present embodiment, each of the linkage members 31 and 32 is hingedly engaged with each of the portions 23, 24, 25, 26 of the foldable assemblies equidistantly about the respective fold axes a and b. That is, the pivot joints about which the portions 23, 24, 25, 26 pivot are disposed equidistantly about the respective fold axes a and b. However, those skilled in the art will appreciate that the pivot joints may be disposed otherwise without departing from the scope of the invention.

Figure 4:
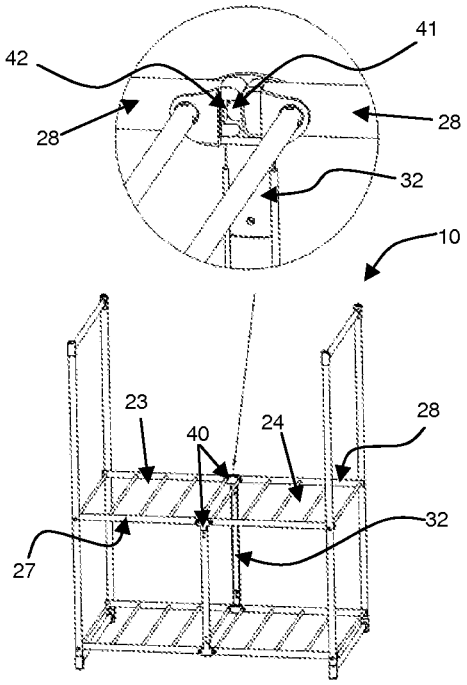
FIG. 4 shows a perspective view of an embodiment of a locking assembly of an expandable clothes frame in accordance with the present invention.
Figure 5:
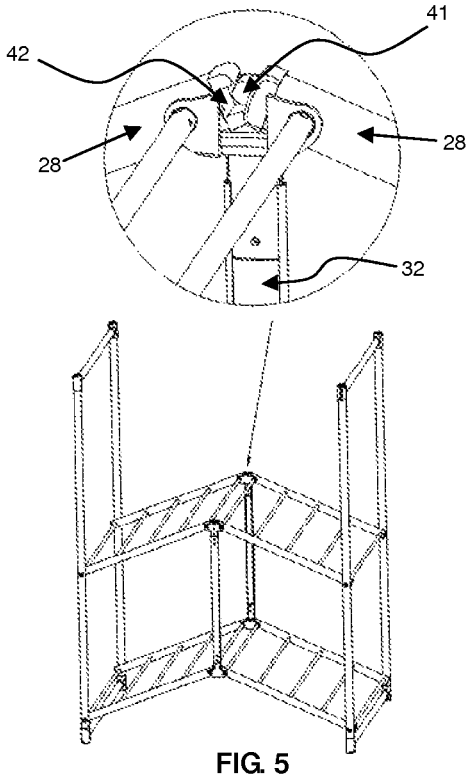
FIG. 5 shows a perspective view of the locking assembly of FIG. 4 in which the expandable clothes frame is in a partially retracted configuration.
Figure 6:
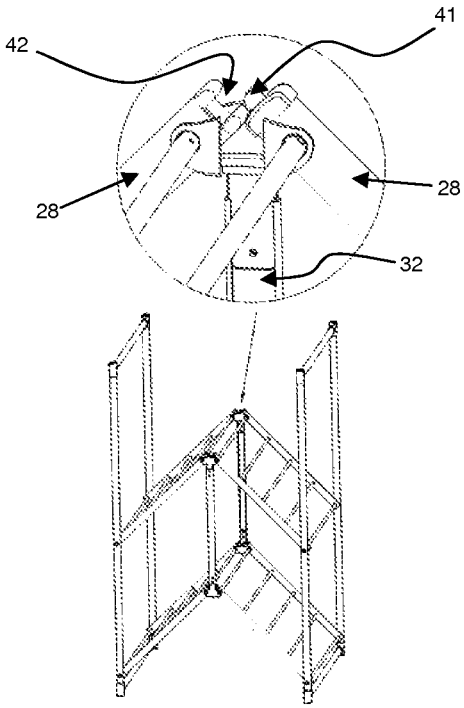
FIG. 6 shows a perspective view of the locking assembly of FIG. 4 in which the expandable clothes frame is in another partially retracted configuration.

Referring to FIGS. 4, 5 and 6, there is shown an exemplary representation of a locking assembly 40 for use in the expandable clothes frame 10 according to the present invention. The locking assembly 40 as claimed and described is suitable for reversibly securing the two portions 23 and 24 of the upper foldable assemblies, and/or the two portions 25 and 26 of the lower foldable assemblies, across their respective axes a and b, such that the two portions are held immoveable relative to each other. As best shown in FIG. 6, the locking assembly includes engageable and cooperative portions, or a protrusion 41 and a recess 42. The protrusion 41 is sized and shaped such that it may be received within the recess 42 for securing the two portions relative to each other. Biasing means, such as a spring (not shown), may be provided to urge the protrusion 41 into the recess 42, although the spring is not essential for securing of the two portions. In the present embodiment, the protrusion 41 and the recess 42 are provided respectively on the two portions 23, 24 of the upper foldable assembly 21. Upon urging the retracted foldable assemblies 21 and 22 downwardly, the frame is urged towards the extended configuration from the retracted configuration, the protrusion 41 and recess 42 are urged towards each other. When the protrusion 41 is received within the recess 42, the protrusion 41 and recess 42 cooperate to hold the two portions 23 and 24 of the upper foldable assembly 21 relative to each other. As the upper foldable assembly 21 and lower foldable assembly 22 are linked by the linkage assembly 30, the two portions 25, 26 of the lower foldable assembly 22 are also secured relative to each other. By urging the protrusion 41 out of the recess 42, no securing force will act upon the two portions 23 and 24 of the upper foldable assembly 21, thereby allowing them to fold freely relative to each other. In the present embodiment, lifting at least one of the foldable assemblies 21 and 22 upwardly or urging the end support assemblies 11 and 12 towards each other urges the protrusion 41 out of the recess 42, and as such allowing the expandable clothes frame 10 to move from the extended configuration to the retracted configuration.

Those skilled in the art will appreciate that the protrusion 41 and the recess 42 may be arranged in a different manner than that described above. For instance, a plurality of protrusions may be provided on both of the two portions 23 and 24 of the upper foldable assembly 21 and the recess is disposed at the linkage assembly 30 for receiving the protrusions. Alternatively, recesses may be provided on both of the two portions 23 and 24 of the upper foldable assembly 21 for receiving respective protrusions provided on the linkage assembly 30. Alternatively, a recess and a protrusion may be provided respectively on the two portions 23 and 24 of the upper foldable assembly 21 for engaging with the respective protrusion and recess provided on the linkage assembly 30.

Although in the exemplary embodiment the locking assembly 40 comprises complementary protrusions and recesses provided at each of the two lateral arms 27 and 28 of the upper foldable assembly 21, those skilled in the art will appreciate that the locking assembly 40 may be disposed at other different location or may comprise different number of locking members for securing the two portions 23 and 24. For instance, a single locking member comprising a protrusion and a recess may be disposed respectively at the two portions 23 and 24 intermediate or midway between the two lateral arms 27 and 28. Furthermore, in the present embodiment the protrusion 41 and recess 42 are formed from polymeric material, but those skilled in the art will understand that other material may be used.

Figure 7:
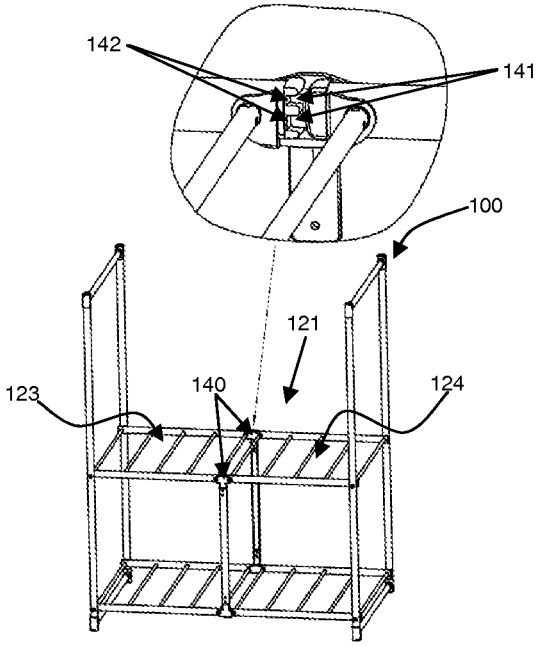
FIG. 7 shows a perspective view of another embodiment of a locking assembly of an expandable clothes frame in accordance with the present invention in which the frame is in an extended configuration.
Figure 8:
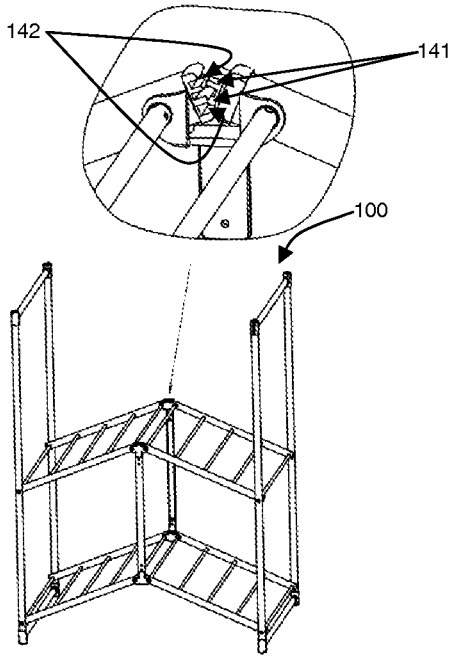
FIG. 8 shows a perspective view of the locking assembly of FIG. 7 in which the frame is in a partially retracted configuration.

Referring to FIGS. 7 and 8, there is shown an exemplary representation of another locking assembly 140 for use in the expandable clothes frame 100 according to the present invention. The locking assembly 140 comprises two protrusions 141 and two recesses 142 respectively disposed at the two portions 123, 124 of the upper foldable assembly 121. As will be appreciated by those skilled in the art, the locking assembly 140 may comprise different number of protrusion/recess pairs as needed. The increased number of protrusions and recesses will enhance the securing between the two portions, and as such hold the expandable clothes frame 100 in the extended configuration more securely.

Although in the exemplary embodiments the locking assembly 40 locks the foldable assemblies 21 and 22 at the extended configuration of the expandable clothes frame 10, those skilled in the art will readily understand that the locking assembly may be arranged to lock the foldable assemblies 21 and 22 at a configuration other than the extended configuration, for instance a partially retracted configuration. Furthermore, although each of the foldable assemblies 21 and 22 as described above lies substantially in a horizontal plane when the expandable clothes frame 10 is in the extended configuration, those skilled in the art will appreciate that this may not always be the case. For instance, the foldable assemblies 21 and 22 may be formed of curved frames and therefore will not lie in horizontal planes when the frame is at the extended configuration.

Figure 9:
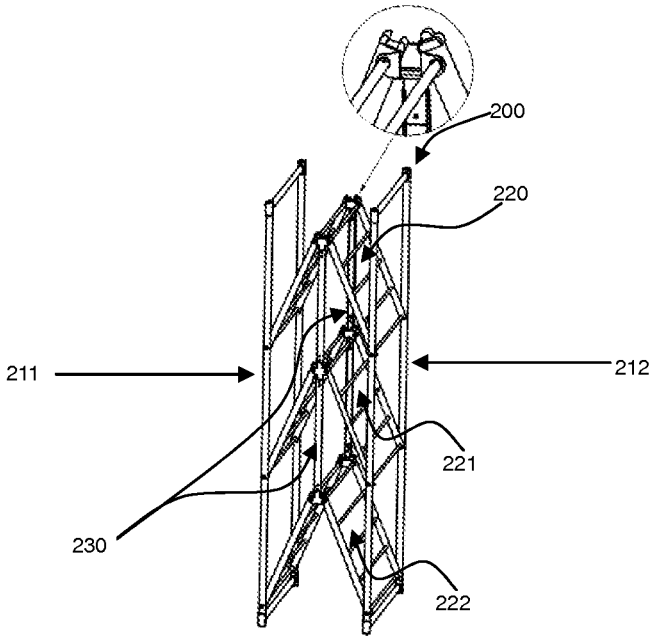
FIG. 9 shows a perspective view of a further embodiment of an expandable clothes frame according to the present invention, in which the frame is in a partially retracted configuration.
Figure 10:
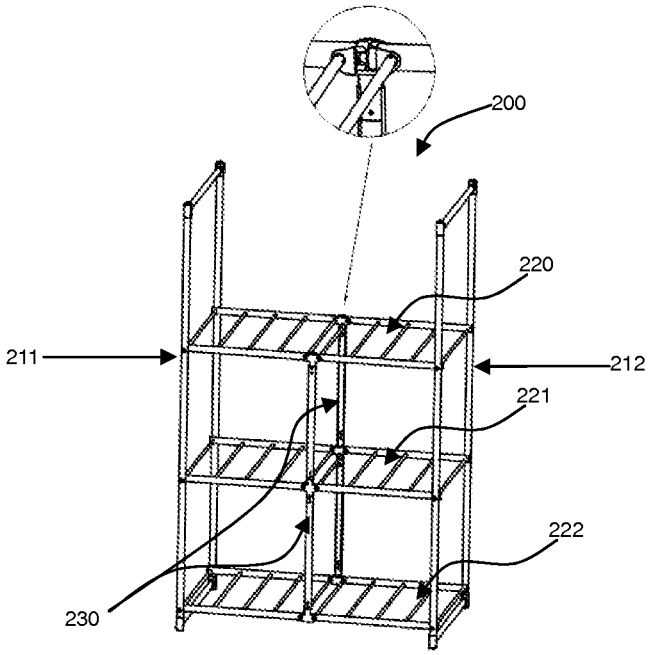
FIG. 10 shows a perspective view of the expandable clothes frame of FIG. 9 in which the frame is in an extended configuration.

Referring to FIGS. 9 and 10, there is shown an exemplary representation of another expandable clothes frame 200 according to the present invention. As compared with the embodiments described above, the frame 200 comprises, in addition to two foldable assemblies 221 and 222, a further foldable assembly 220. The further foldable assembly 220 is maintained longitudinally spaced apart from the two longitudinally disposed foldable assemblies 221 and 222 and maintained parallel with the two longitudinally disposed foldable assemblies 221 and 222 by the linkage assembly 230. Each of the foldable assemblies 220, 221 and 222 is provided in two portions, and is hingedly engaged with each of the pair of end support assemblies 211 and 212.

Figure 11:
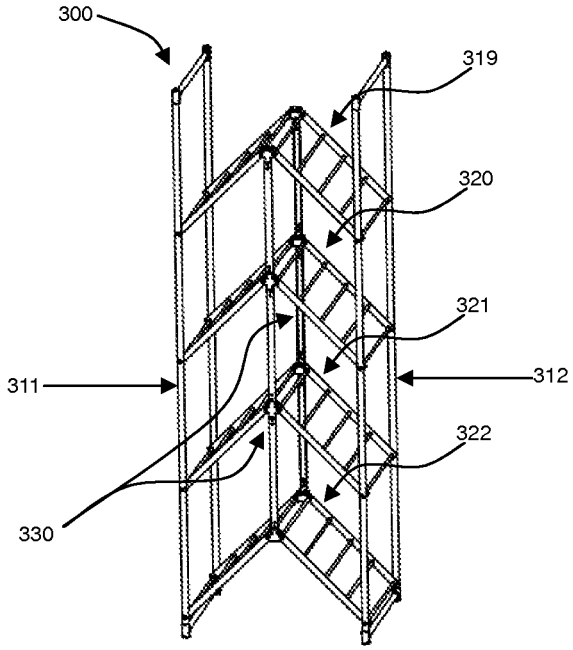
FIG. 11 shows a perspective view of a further embodiment of an expandable clothes frame according to the present invention, in which the frame is in a partially retracted configuration.
Figure 12:
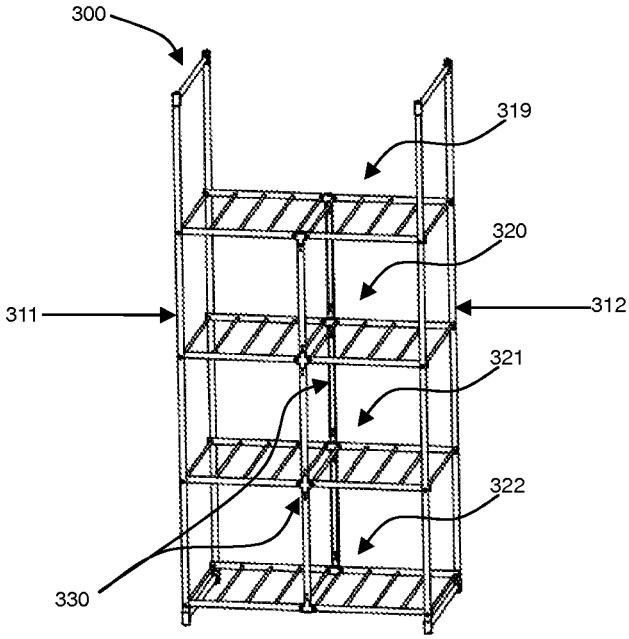
FIG. 12 shows a perspective view of the expandable clothes frame of FIG. 11 in which the frame is in an extended configuration.

Referring to FIGS. 11 and 12, there is shown an exemplary representation of a further expandable clothes frame 300 according to the present invention. As compared with the embodiment in FIGS. 9 and 10, the frame 300 comprises a further foldable assembly 319 in addition to three foldable assemblies 320, 321 and 322. The foldable assemblies 319, 320, 321 and 322 are maintained longitudinally spaced apart from and parallel with one another via the linkage assembly 330. Each of the foldable assemblies 319, 320, 321 and 322 is provided in two portions, and is hingedly engaged with each of the pair of end support assemblies 311 and 312.

Figure 13:
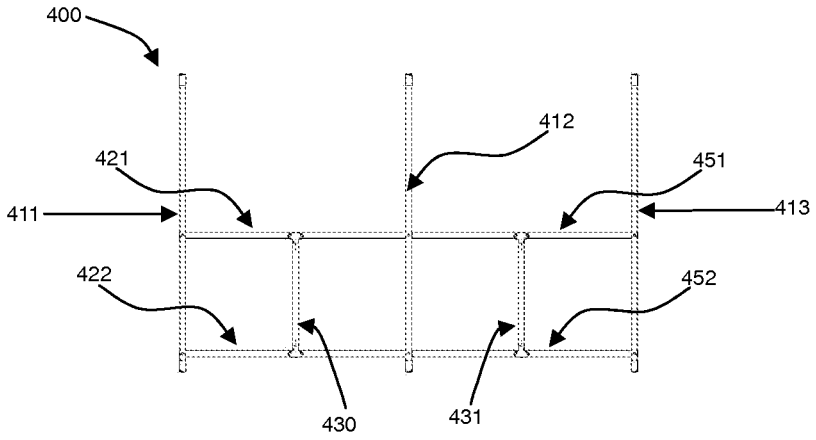
FIG. 13 shows a front view of a further embodiment of an expandable clothes frame according to the present invention, in which the frame is in an extended configuration.
Figure 14A:
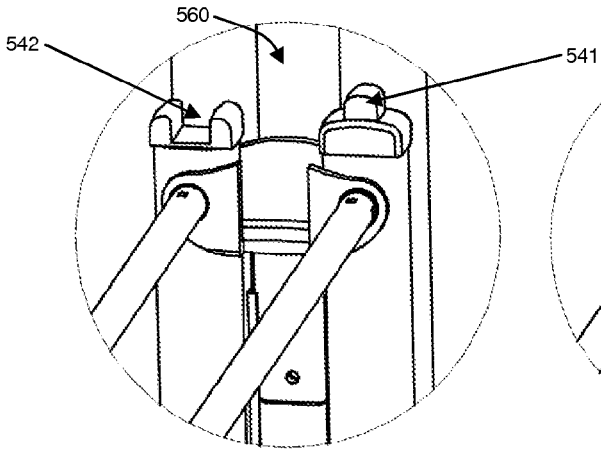
FIGS. 14(*a*) to 14(*e*) show enlarged perspective views of an embodiment of a locking member according to the present invention for use in an expandable clothes frame.
Figure 14B:
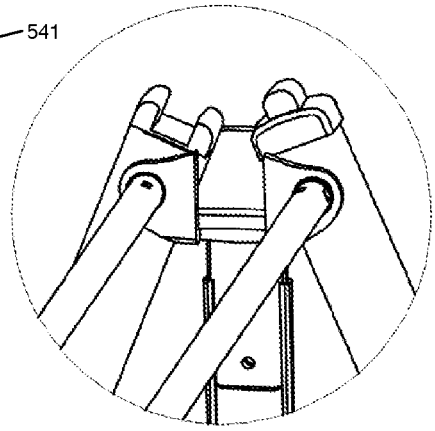
Figure 14C:
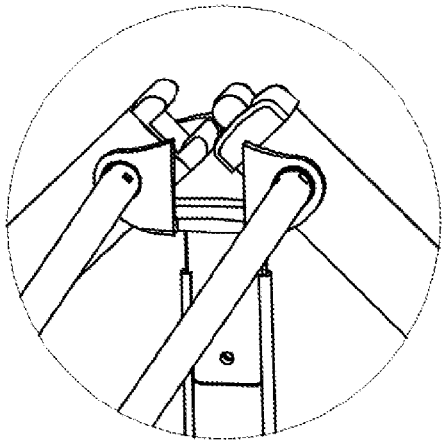
Figure 14D:
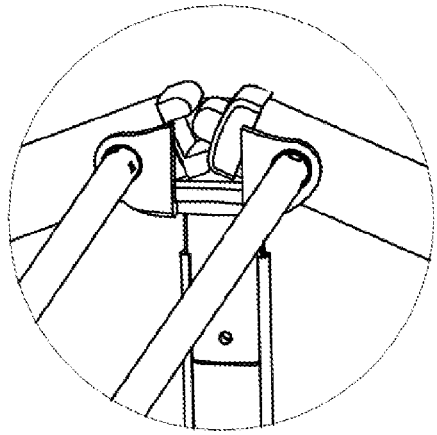
Figure 14E:
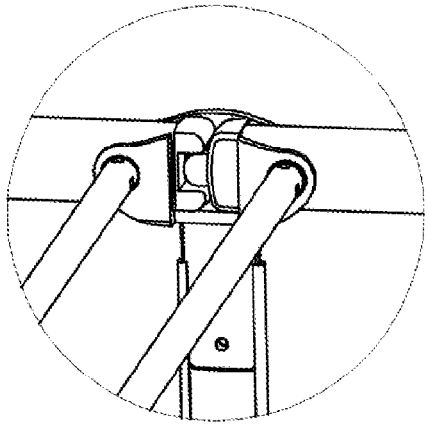
Figure 15A:
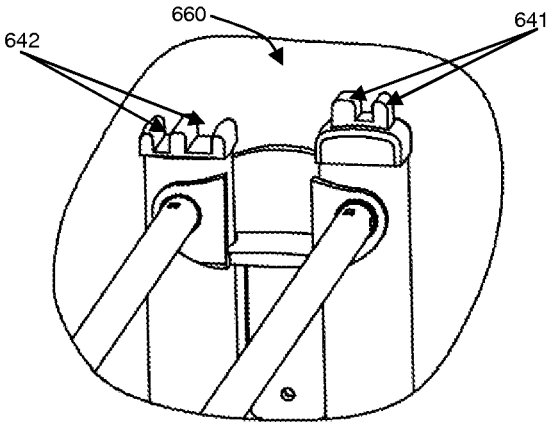
FIGS. 15(*a*) to 15(*e*) show enlarged perspective views of a further embodiment of a locking member according to the present invention for use in an expandable clothes frame.
Figure 15B:
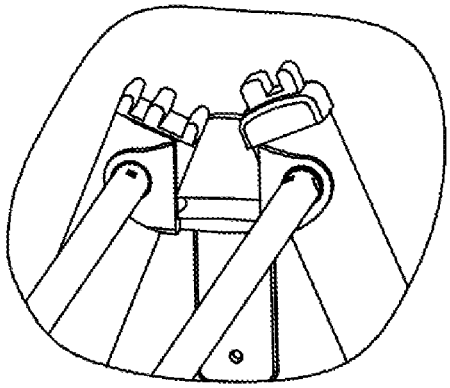
Figure 15C:
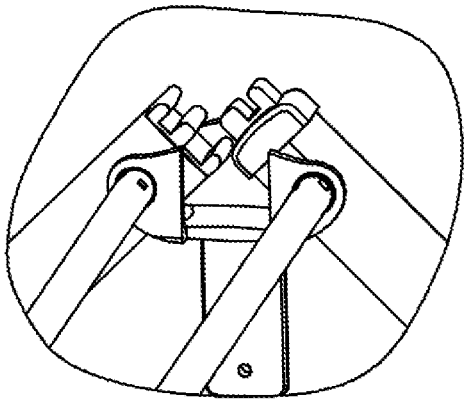
Figure 15D:
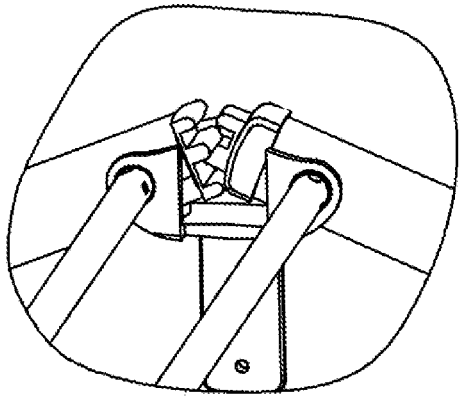
Figure 15E:
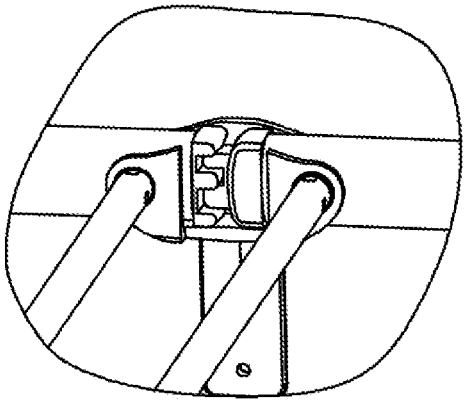
Figure 16A:
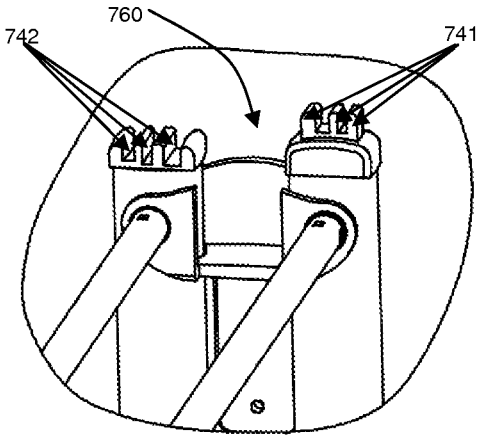
FIGS. 16(*a*) to 16(*e*) show enlarged perspective views of a further embodiment of a locking member according to the present invention for use in an expandable clothes frame.
Figure 16B:
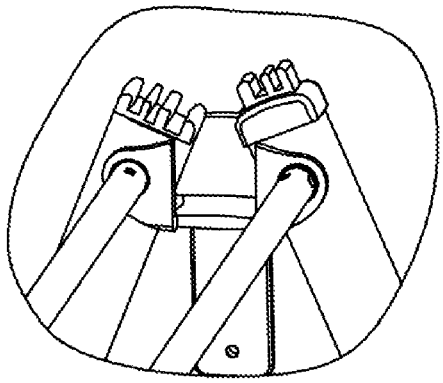
Figure 16C:
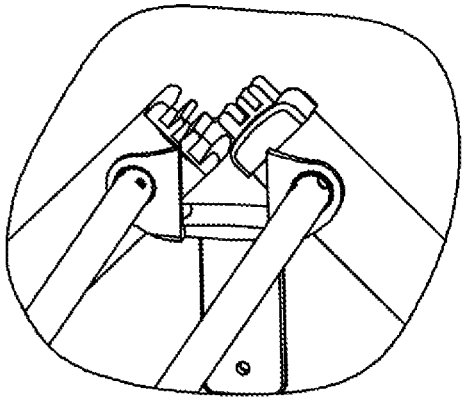
Figure 16D:
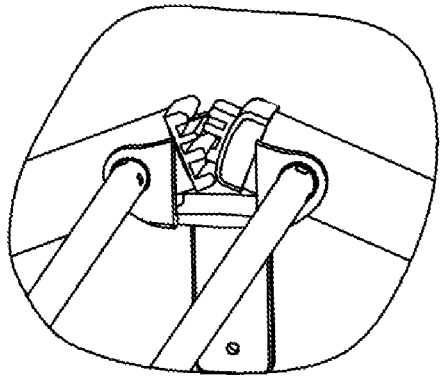
Figure 16E:
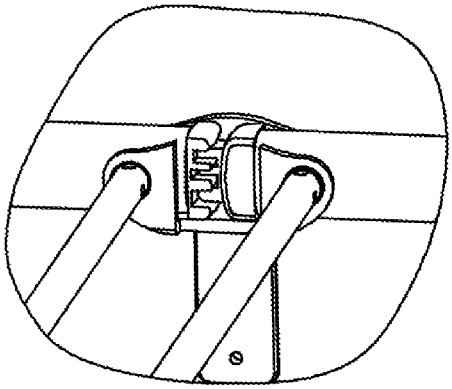

Referring to FIG. 13, there is shown an exemplary representation of another expandable clothes frame 400 in an extended configuration according to the present invention. As compared with the embodiments as described above, the frame 400 comprises a further end support assembly 413 in addition to a pair of end support assemblies 411 and 412. The end support assembly 413 is maintained in a parallel laterally spaced apart relationship with the pair of laterally disposed end support assemblies 411 and 412 by third and fourth foldable assemblies 451 and 452. The foldable assemblies 421, 422, 451 and 452 are maintained longitudinally spaced apart from and parallel with one another via corresponding linkage assemblies 430 and 431. However, those skilled in the art will appreciate that different number of foldable assemblies than that illustrated in FIG. 13 may be used without departing from the scope of the invention. For instance, there may be three foldable assemblies disposed intermediate the end support assemblies 411 and 412 and one single foldable assembly disposed intermediate the end support assemblies 412 and 413. In the case where only one foldable assembly is disposed intermediate a pair of end support assemblies, no linkage assembly may be required. Similarly, those skilled in the art will appreciate that different number of end support assemblies than that illustrated in FIG. 13 may be used without departing from the scope of the invention. For instance, there may be four end support assemblies, in which two adjacent end support assemblies are maintained in a parallel laterally spaced apart relationship with a pair of foldable assemblies.

Referring to FIGS. 14(*a*), 14(*b*), 14(*c*), 14(*d*) and 14(*e*), there is shown an exemplary representation of a locking member 560 for use in an expandable clothes frame according to the present invention. In this specific embodiment, the locking member 560 comprises a single protrusion 541 and a single recess 542. Relative positions of the protrusion 541 and the recess 542 are shown when the expandable clothes frame is in a fully retracted configuration (FIG. 14(*a*)), partially retracted configurations (FIGS. 14(*b*) to (*d*)), and a fully extended configuration (FIG. 14(*e*)). As will be appreciated by those skilled in the art, the locking member 560 may comprise different number of protrusion/recess pairs as needed.

Referring to FIGS. 15(*a*), 15(*b*), 15(*c*), 15(*d*) and 15(*e*), there is shown an exemplary representation of a further locking member 660 for use in an expandable clothes frame according to the present invention. As compared with the locking member 560, the locking member 660 comprises two protrusions 641 and two complementary recesses 642 adapted to receive the two protrusions 641. Relative positions of the protrusions 641 and the recesses 642 are shown when the expandable clothes frame is in a fully retracted configuration (FIG. 15(*a*)), partially retracted configurations (FIGS. 15(*b*) to (*d*)), and a fully extended configuration (FIG. 15(*e*)).

Referring to FIGS. 16(*a*), 16(*b*), 16(*c*), 16(*d*) and 16(*e*), there is shown an exemplary representation of a further locking member 760 for use in an expandable clothes frame according to the present invention. The locking member 760 comprises three protrusions 741 and three complementary recesses 742 adapted to receive the three protrusions 741. Relative positions of the protrusions 741 and the recesses 742 are shown when the expandable clothes frame is in a fully retracted configuration (FIG. 16(*a*)), partially retracted configurations (FIGS. 16(*b*) to *d*)) and a fully extended configuration (FIG. 16(*e*)).

As will be appreciated by those skilled in the art, the locking assembly according to the present invention provides easy locking/unlocking of the foldable assemblies of expandable clothes frame. Those skilled in the art will appreciate that the present invention, by way of provision of the locking assembly as described above, a user is able to move the expandable clothes frame between the extended configuration and retracted configuration easily and with little effort.

While the present invention has been explained by reference to the examples or preferred embodiments described above, it will be appreciated that those are examples to assist understanding of the present invention and are not meant to be restrictive. Variations or modifications which are obvious or trivial to persons skilled in the art, as well as improvements made thereon, should be considered as equivalents of this invention.

The invention claimed is:

1. An expandable clothes frame moveable between a retracted configuration for storage and an extended configuration for supporting articles of clothing, the frame comprising:

a pair of laterally disposed end support assemblies for engagement with and support by a ground surface upon which the frame is to be supported and extending longitudinally therefrom;

two longitudinally disposed foldable assemblies each extending between and hingedly engaged with each of the end support assemblies, wherein each foldable assembly is provided in two portions having relative movement therebetween to allow folding of each foldable assembly about a fold axis between the pair of end support assemblies and wherein the fold axes of each foldable assembly are coplanar and parallel;

a linkage assembly extending longitudinally between the foldable assemblies, wherein the linkage assembly is configured such that upon the foldable assemblies being folded about the fold axes the end support assemblies are urged from towards each other and are maintained parallel with each other as the frame is moved from the extended configuration towards the retracted configuration; and a locking assembly for securing the two portions of at least one of the foldable assemblies relative to each other so as to secure the frame in said extended configuration, the locking assembly includes engageable and cooperative portions;

wherein upon the frame being urged towards the extended configuration the engageable and cooperative portions are urged towards each other and engage so as to secure the two portions relative to each other and maintain the frame in the extended configuration; and upon the frame being urged from the extended configuration towards the retracted configuration the engagement of the cooperative portions is overcome to allow the frame to be moved to the retracted configuration;

wherein the engageable and cooperative portions comprise at least one protrusion and at least one recess, the at least one protrusion being configured to be received within the at least one recess for securing the two portions of at least one of the foldable assemblies relative to each other; and wherein the at least one protrusion and the at least one recess are disposed respectively at each of the two portions of at least one of the foldable assemblies.

2. An expandable clothes frame according to claim 1, wherein the fold axes of the foldable assemblies extend in a plane substantially midway between the pair of end support assemblies.

3. An expandable clothes frame according to claim 1, wherein the linkage assembly comprises a linkage member extending longitudinally and midway between two lateral sides of each of the foldable assemblies.

4. An expandable clothes frame according to claim 3, wherein the linkage assembly has a generally elongate structure.

5. An expandable clothes frame according to claim 3, wherein the linkage assembly is hingedly engaged with the foldable assemblies about the fold axes.

6. An expandable claims frame according to claim 3, wherein the linkage assembly is hingedly engaged with each of the two portions of the foldable assemblies equidistantly about the respective fold axes.

7. An expandable clothes frame according to claim 1, wherein the linkage assembly comprises a pair of oppositely disposed linkage members, the pair of linkage members bridging the portions of the foldable assemblies at two lateral sides of the foldable assemblies and across the fold axes.

8. An expandable clothes frame according to claim 1, wherein the at least one protrusion and the at least one recess are provided at two lateral sides of at least one of the foldable assemblies.

9. An expandable clothes frame according to claim 1, wherein the at least one recess is disposed at the linkage assembly to receive at least one protrusion disposed at each of the two portions of at least one of the foldable assemblies.

10. An expandable clothes frame according to claim 1, wherein the locking assembly comprises a biasing means for resiliently urging the at least one protrusion into the at least one recess.

11. An expandable clothes frame according to claim 1, wherein the foldable assemblies each comprises a pair of laterally disposed elongate arm members being maintained in a parallel spaced apart relationship by a plurality of spaced apart clothes hanging members extending therebetween.

12. An expandable clothes frame according to claim 1, wherein the foldable assemblies each comprises a plurality of laterally extending spaced apart clothes hanging members.

13. An expandable clothes frame according to claim 1, wherein the end support assemblies each comprises a pair of generally upright support stands maintained in a parallel spaced apart relationship by a plurality of longitudinally spaced apart bars extending therebetween.

14. An expandable clothes frame according to claim 13, wherein the end support assemblies each comprises a pair of wheels for engaging with the ground surface.

* * * * *